United States Patent [19]

Williamson, Jr.

[11] Patent Number: 4,691,777

[45] Date of Patent: Sep. 8, 1987

[54] STANDING AND INJECTION VALVE

[75] Inventor: Jimmie R. Williamson, Jr., Carrollton, Tex.

[73] Assignee: Otis Engineering Corporation, Dallas, Tex.

[21] Appl. No.: 849,125

[22] Filed: Apr. 7, 1986

[51] Int. Cl.[4] ..... E21B 37/00

[52] U.S. Cl. ..... 166/319; 166/332

[58] Field of Search ..... 166/319, 321, 325, 326, 166/328, 329, 330, 332

[56] References Cited

U.S. PATENT DOCUMENTS

| | | | |
|---|---|---|---|
| 3,845,815 | 11/1974 | Garwood | 166/319 X |
| 4,352,366 | 10/1982 | Fisher, Jr. | 166/321 X |
| 4,467,870 | 8/1984 | Langham | 166/321 |
| 4,475,598 | 10/1984 | Brakhage, Jr. et al. | 166/321 |
| 4,569,397 | 2/1986 | Brakhage, Jr. et al. | 166/321 |
| 4,573,535 | 3/1986 | Manke | 166/321 |
| 4,589,495 | 5/1986 | Langer et al. | 166/325 X |

*Primary Examiner*—Stephen J. Novosad
*Assistant Examiner*—Thomas J. Oda
*Attorney, Agent, or Firm*—Roland O. Cox

[57] ABSTRACT

Two forms of a valve, both useful as a standing valve in a well conduit, permitting upward production flow and preventing downward injection flow. Both forms of this valve may also be operated as injection valves, permitting downward injection flow and preventing upward production flow. One form of the valve utilizes a ball valve for flow control and can be converted to injection only valve operation. The other form of the control valve utilizes an annular valve for flow control and cannot be converted to injection valve only operation. The annular valve and ball valve are biased closed, and both are opened for downward injection flow by increasing valve interior pressure to a pressure which will open a control check valve to permit opening flow to a pressure responsive operator. Opening pressure of the check valve is variable and may be predetermined. When injection flow is reduced sufficiently and the operator is being returned to valve closed position by the bias, opening fluid flow volume returns to the valve interior through other wall flow passages, which provide a larger flow area. Each other flow passage has a check valve permitting flow from the operator back to the valve interior.

11 Claims, 12 Drawing Figures

STANDING AND INJECTION VALVE

BACKGROUND OF THE INVENTION

1. Technical Field

This invention is related to valves and particularly to a valve useful as a standing valve or an injection valve to control flow in a well flow conductor.

2. Background Art

Many standing valves have been developed and used in well flow conductors to permit production flow to the surface when the well reservoir contains sufficient pressure, and close to protect the reservoir from damage caused by pressured flow down the conduit into the reservoir. As it is frequently later desirable to pump chemicals or water for injection into the reservoir, down through the standing valve, standing valves have been developed having a flow passage which may be permanently opened to permit pumped flow down and provide for unrestricted two way flow through the valve. An example of a VELOCITY OPERATED STANDING VALVE is shown in U.S. Pat. No. 4,352,366 to Ernest P. Fisher, Jr. A flow path around the normally closed ball valve in the Fisher standing valve may be opened for downward flow of injected fluids or upward flow of produced fluids. U.S. Pat. No. 4,441,558 to William R. Welch and Thomas J. Heard covers another form of standing valve which may be opened for upward and downward flow. U.S. Pat. No. 4,502,542 discloses a well system which utilizes a standing valve, through which a flow path may be opened to permit two way flow.

DISCLOSURE OF INVENTION

Either form of the standing injection valve of this invention may be used in a well flow conduit or well tool string, to operate repeatedly as a usually bias closed standing valve, opened by higher pressure below or outside the standing injection valve which overcomes the closing bias and opens the valve to permit flow upward in the well conduit. On sufficient reduction in pressure, the bias returns the valve to closed position preventing downward flow through the valve.

Unlike the prior art valves, both the ball valve and annular valve types of the standing injection valve of this invention may also be operated repeatedly as a usually bias closed injection valve, opened for downward injection flow by a predetermined higher pressure from above the valve. There are flow passages in the valve housing wall communicating the interior of the valve with a pressure responsive operator for opening the valve for injection flow. One flow passage has a check valve with a predetermined opening pressure, which may be varied. This check valve permits flow from the standing injection valve interior to the pressure responsive operator, opening the valve for injection. The other wall flow passages have check valves which permit flow from the operator to the valve interior when injection pressure is reduced sufficiently and the bias returns the operator and valve to the closed position. The ball type standing injection valve can be retrieved from the well and converted to operate as an injection only valve. Both the ball type and the annular type standing injection valves will operate as a standing valve when higher pressures are outside the valve or operate as an injection valve when higher pressures are above the valve, without removal from the well conduit.

An object of this invention is to provide a valve useful as a standing valve and an injection valve.

An object of this invention is to provide a standing injection valve, which when used as an injection valve will close on sufficient reduction of injection pressure and prevent upward flow through.

Another object of this invention is to provide a standing injection valve having a variable predetermined injection opening pressure.

Also an object of this invention is to provide a standing injection valve which will close rapidly on sufficient reduction of injection flow rate.

Another object of this invention is to provide a ball type standing injection valve which operates as a standing valve when the ball valve slides in the valve housing and operates as an injection only valve when the ball valve is prevented from sliding.

Also an object of this invention is to provide a standing injection valve which may include a choke controlling injected volume flow or production volume flow through the valve.

BEST MODE FOR CARRYING OUT THE INVENTION

Figure 1:
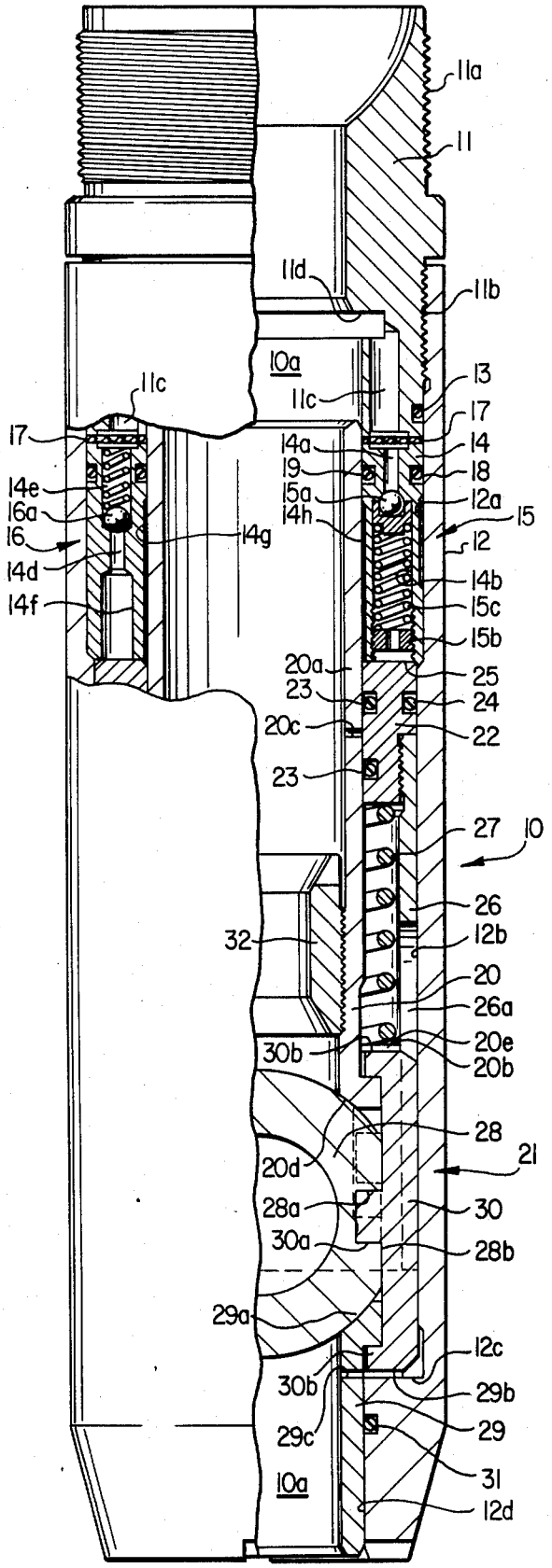
FIG. 1 is a partially sectioned elevation view drawing of the ball valve form of the standing injection valve of this invention in closed position.

FIGS. 1, 2, 3 and 4 show one preferred form 10 of the standing injection valve of this invention, which utilizes a ball type valve. As shown in FIG. 1, the valve 10 has a flow passage 10*a* and a connector 11, which includes an appropriate thread 11*a* for connecting the valve to a tool string or in a well conduit. The connector has another thread 11*b* connecting it to a housing 12. Resilient seal 13 seals the connector to the housing. The housing has bore 12*a* in which is installed control valve housing 14. This housing has a flow passage hole 14*a* which has a bore counter 14*b* and a control inlet check valve 15 is installed in the bore. The check valve ball 15*a* sealingly engages seating surface 14*c* in valve housing 14 and adjusting screw 15*b* is turned to compress spring 15*c* more or less. The control valve housing has at least one more flow passage hole 14*d*, which has a counterbore 14*e* and counterbore 14*f*. A control outlet check valve 16 is installed in bore 14*e*. Check valve ball 16*a* sealingly engages seating surface 14*g* in control valve housing 14.

Connector 11 has wall flow passages 11*c* which communicate between flow passage 10*a* and passages 14*a* and bore 14*e*. This connector also has a shoulder 11*d*. A filter 17 is trapped between connector 11 and control valve housing 14. Resilient seal 18 seals the housing 14 in housing bore 12*a* and resilient seal 19 seals the housing around an extention 20*a* of the upper seat 20 for ball valve 21. This extension is slidably mounted in control valve housing longitudinal bore 14*h*.

Figure 5:
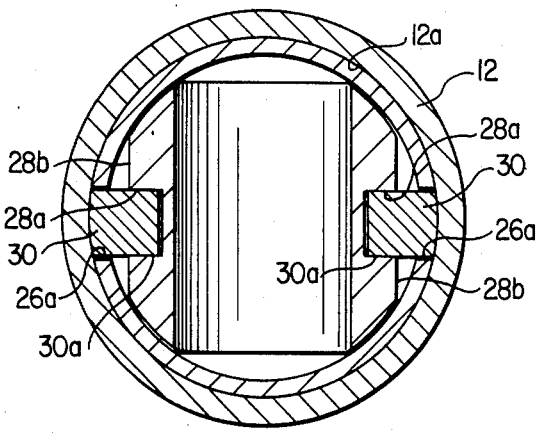
FIG. 5 is a cross section drawing of the closed valve of FIG. 3, viewed as indicated along line 5—5 in FIG. 3.
Figure 6:
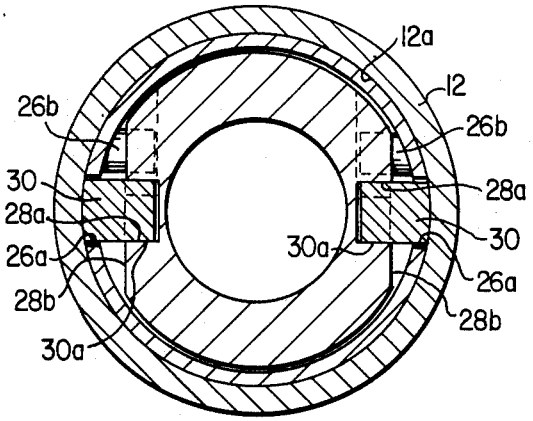
FIG. 6 is a cross section drawing of the open valve of FIG. 4, viewed as indicated along line 6—6 of FIG. 4.
Figure 9:
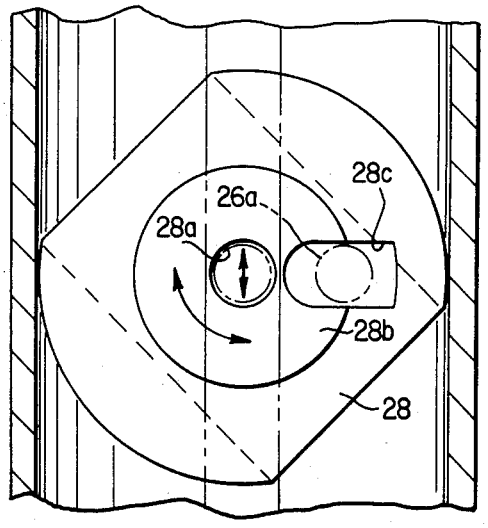
FIG. 9 is an enlarged drawing showing the valve ball moveable between open and closed positions by the arm pins.
Figure 7:
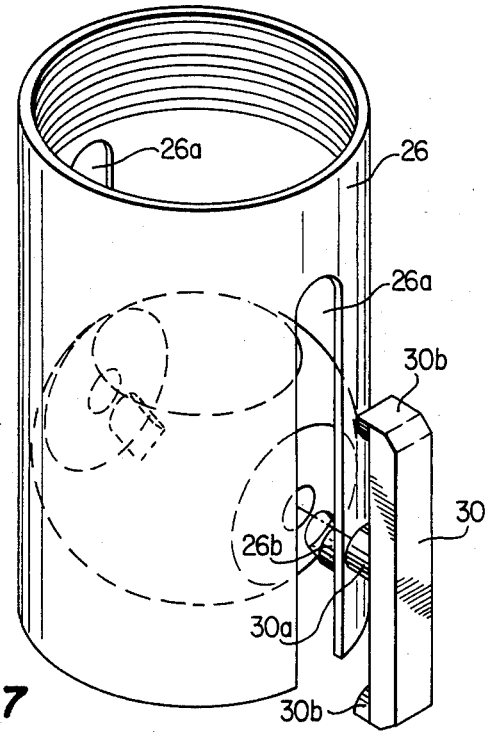
FIG. 7 is an exploded view drawing showing the elements which operate the valve ball between open and closed positions.

Housing 12 has another bore 12*b* in which an annular piston 22 is slidably mounted around upper seat extension 20*a*. This piston is sealed around the seat extension with resilient seals 23 and sealed in bore 12*b* with seal 24 to form a variable volume pressure chamber 25 with control valve housing 14, housing 12 and seat extension 20*a*. Threadedly connected to piston 22 is a sleeve 26 having opposite slots 26*a* which are better shown in FIG. 7. The upper seat 20 has a shoulder 20*b* on which spring 27 bears and pushes piston 22 up to contact the lower end of control valve housing 14. Upper seat extension 20 is provided with a flow port 20*c*, which is positioned between seals 23 when piston 22 is up. A valve ball 28 is held in sealing engagement with sealing surface 20*d* on upper seat 20 and sealing surface 29*a* on lower seat 29 by arms 30, which are slidably disposed in sleeve slots 26*a*, (see also FIGS. 5 and 6). Each arm 30 has a pin 30*a*, which is rotatably engaged in a hole 28*a* in ball flat surface 28*b*. Each arm also has projections 30*b* which are engaged in upper seat slots 20*e* and in lower seat slots 29*b*.

The valve ball 28 is also provided with an open ended slot 28*c* in each flat surface 28*b*, see FIGS. 5, 6, 7, 8 and 9. The sleeve 26 has opposite pins 26*b*, which may be seen in FIGS. 6 and 7. Each pin is slidably positioned by sleeve 26 in a valve ball flat slot 28*c*. FIG. 1 shows the body 12 is provided with a stop shoulder 12*c* and another bore 12*d*. The lower seat 29, which also has a flow port 29*c* is slidably mounted and sealed in housing bore 12*d* by resilient seal 31. An appropriate connection may be included on the lower end of housing 12 for connection of the standing injection valve into a well flow conductor or well tool string. A choke 32 restricting flow in flow passage 10*a* has been installed in upper seat extension 20*a*.

Figure 2:
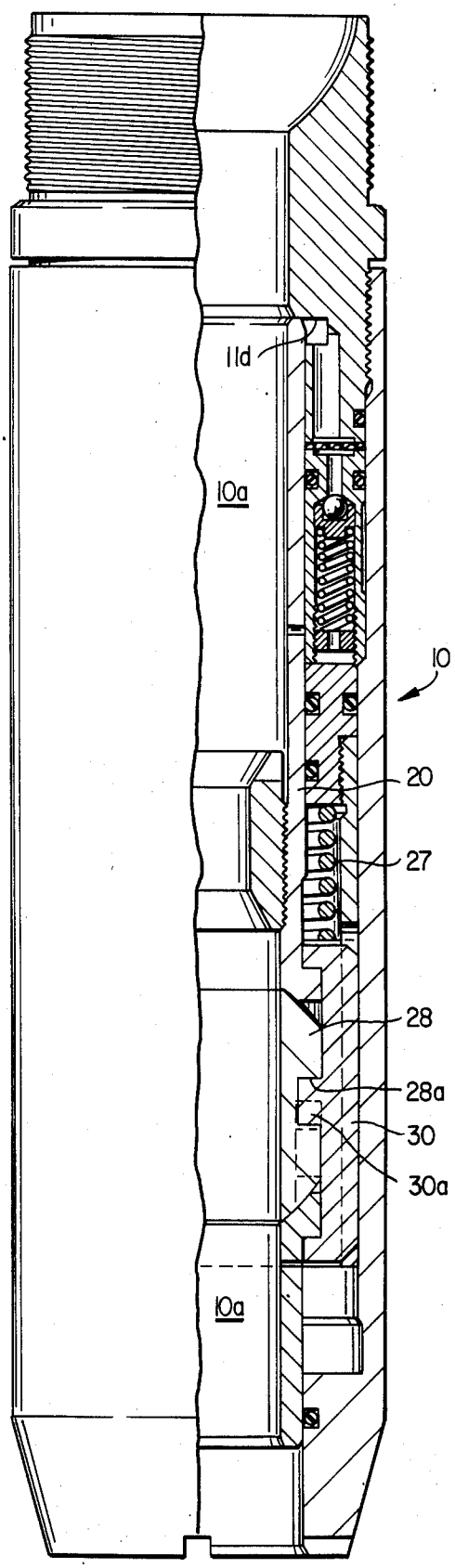
FIG. 2 is a partially sectioned elevation view drawing of the standing injection valve of FIG. 1 open for production flow.

To use the biased to closed position ball valve form of the standing injection valve shown in FIG. 1 as a standing valve or an injection valve, adjusting screw 15*b* should be turned to set the designed opening pressure of inlet control valve 15 and ball valve 21 for injection and valve 10 should be installed at the proper level in the well flow conduit. When higher pressure acting upward from below on the area closed by ball 28 on upper seat 20 and sealed by seal 23 on the outside of upper seat extension 20*a* produces sufficient force to move upper seat 20 up and compress spring 27, arms 30 are pulled up by the upper seat. Upward movement of piston 22 and attached sleeve 26 with pins 26*b* is prevented by control valve housing 14. On increase in the pressure below the ball and upward force, the lower seat moves upwardly and compresses the spring further, while arms 30 and pins 30*a* in ball holes 28*a* have rotated (see FIG. 9) valve ball 28 around sleeve pins 26*b* to open position as shown in FIG. 2, permitting flow upward through flow passage 10*a*. When flow and pressure from below decrease sufficiently, compressed spring 27 extends and slides the valve 21 downwardly, while the valve ball 28 is rotated (see FIG. 9) around sleeve pins 26*b* to return the ball valve to closed position as shown in FIG. 1. Higher pressure not exceeding the opening pressure of inlet control valve 15 above the closed valve in flow passage 10*a* acting downwardly on the area closed by ball 28 on seat 29 and sealed by seal 23 on the outside of extension 20*a* produces a down force which cannot move the upper seat down and rotate the ball to open position because down movement of the upper seat is prevented. The seat cannot push the valve ball and arm pins 30 down, rotating the ball about sleeve pin 26*a*, as the lower end of arm 30 contacts housing shoulder 12*c*.

Figure 3:
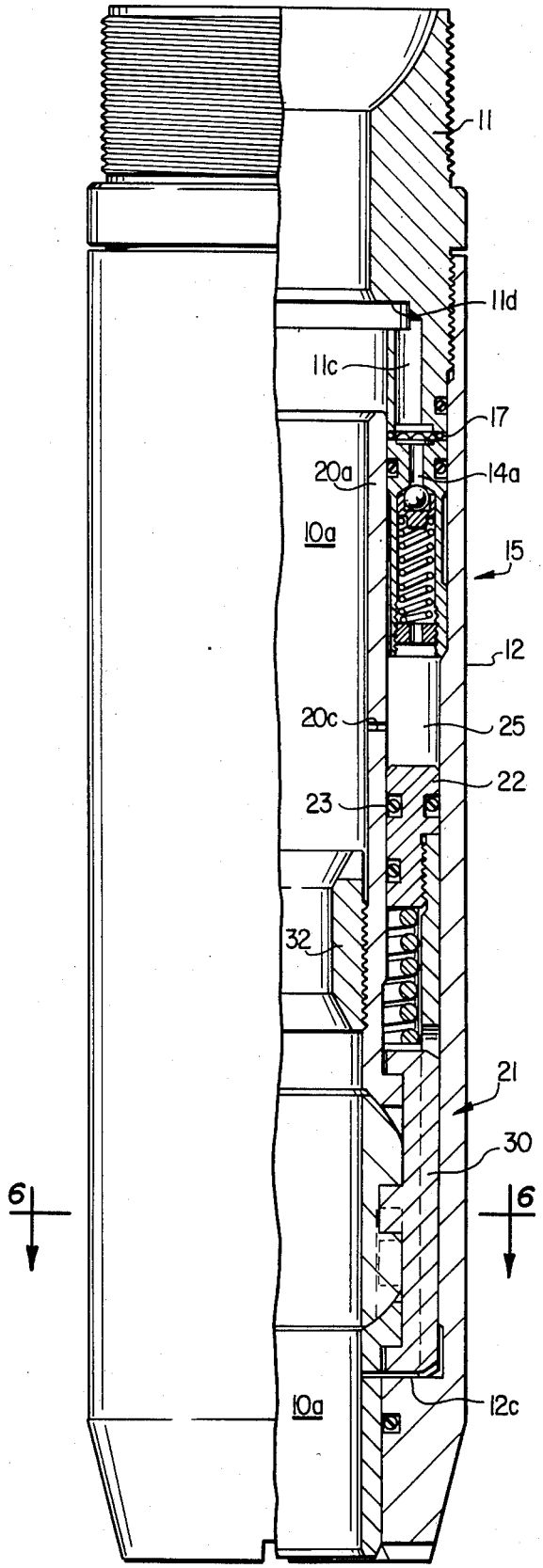
FIG. 3 is a partially sectioned elevation view drawing of the ball valve form of the invention standing injection valve open for injection flow.

To operate the ball valve form of the standing injection valve of this invention as an injection valve, pressure is increased in flow passage 10*a* above the closed ball valve 21, to the predetermine opening pressure of valve 15, which acts into flow passages 11*c*, through filter 17, into flow passages 14*a* and 14*e*, opening check valve 15 and closing check valve 16. Flow now occurs through open check valve 15 into chamber 25 and moves piston 22 and sleeve 26 with pins 26*a* downwardly, compressing spring 27. As down movement of arms 30 is prevented by body shoulder 12*c*, downward movement of pins 26*a* in ball slots 28*c* rotate the valve ball around arm pins (see FIG. 8) 30*a* to open position. When upper seal 23 on piston 22 moves below hole 20*c* in upper seat extension 20*a*, pressure in flow passage 10*a* is communicated through hole 20*c* into chamber 25 to act on piston 22. Increased pressure in passage 10*a* and injection flow through valve 21 will move the valve 21 to open position as shown in FIG. 3. If desired, choke 32 may be sized to limit injected flow volume or production flow volume into the well conduit.

Figure 8:
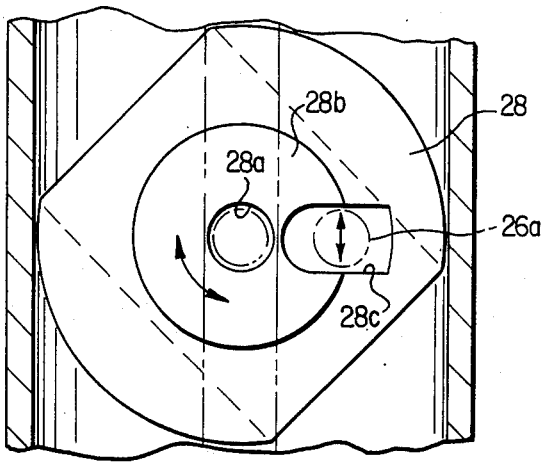
FIG. 8 is an enlarged drawing showing the valve ball moveable between open and closed positions by the sleeve pins.

On reduction of injected flow through valve 21 and pressure in flow passage 10*a*, spring 27 extends moving the piston, sleeve and pins 26*a* upward, exhausting fluid from chamber 25 through port 20*c* into flow passage 10*a* and rotating the valve ball around arm pins 30*a* back towards closed position (see FIG. 8). When upper piston seal 23 is moved above hole 20*c*, fluid exhausting from chamber 25 closes check valve 15 and acts through counterbore 14*f* and hole 14*d* to open check valve 16 permitting flow exhausting from chamber 25 to flow through counterbore 14*e*, filter 17 and flow passage 11*c* back into flow passage 10*a*. To provide a larger flow area for exhaust fluid from chamber 25, additional outlet check valves 16 may be installed in additional counterbores 14*e* in control valve housing 14. When piston 22 upward travel is stopped by the lower end of control valve housing 14, valve 21 has returned to closed position as shown in FIG. 1. Standing injection valve 10 will continue to operate repeatedly as a standing valve when production pressure below increases to open valve 21 or operate repeatedly as an injection valve when pressure above valve 21 in the well conduit is increased to the opening pressure of inlet control valve 15 and valve 21.

Figure 4:
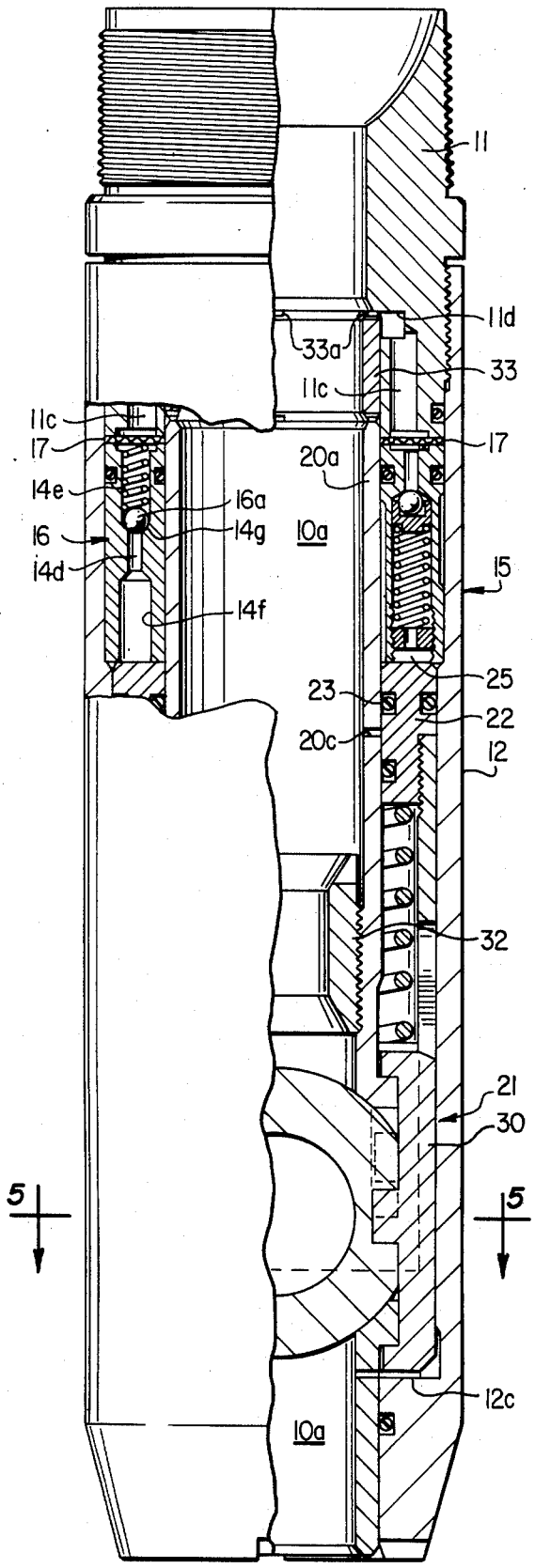
FIG. 4 is a partially sectioned elevation view drawing of the standing injection valve of this invention operable as an injection valve only.

The ball valve form of the standing injection valve of this invention may be operated as an injection valve only, by adding before installation in the well conduit, a spacer 33 shown in FIG. 4. This spacer has slots 33*a* and is installed between the top end of seat extension 20*a* and shoulder 11*d* in connector 11. After setting the opening pressure of inlet check valve 15 and installing valve 10 in the well conduit, production pressure from below closed valve 21 in flow passage 10*a* cannot move valve ball 28 and the upper seat upwardly to open the valve for upward flow because upward movement of the upper seat is prevented by spacer 33 and valve 21 cannot slide upwardly in housing 12 to open position. The valve 15 now cannot operate as a standing valve, but may be opened for injection flow as previously described by increasing pressure in flow passage 10*a* above closed ball valve 21 to the predetermined opening pressure of valve 15 which acts through slots 33*a* into flow passages 11*c*.

Figure 10:
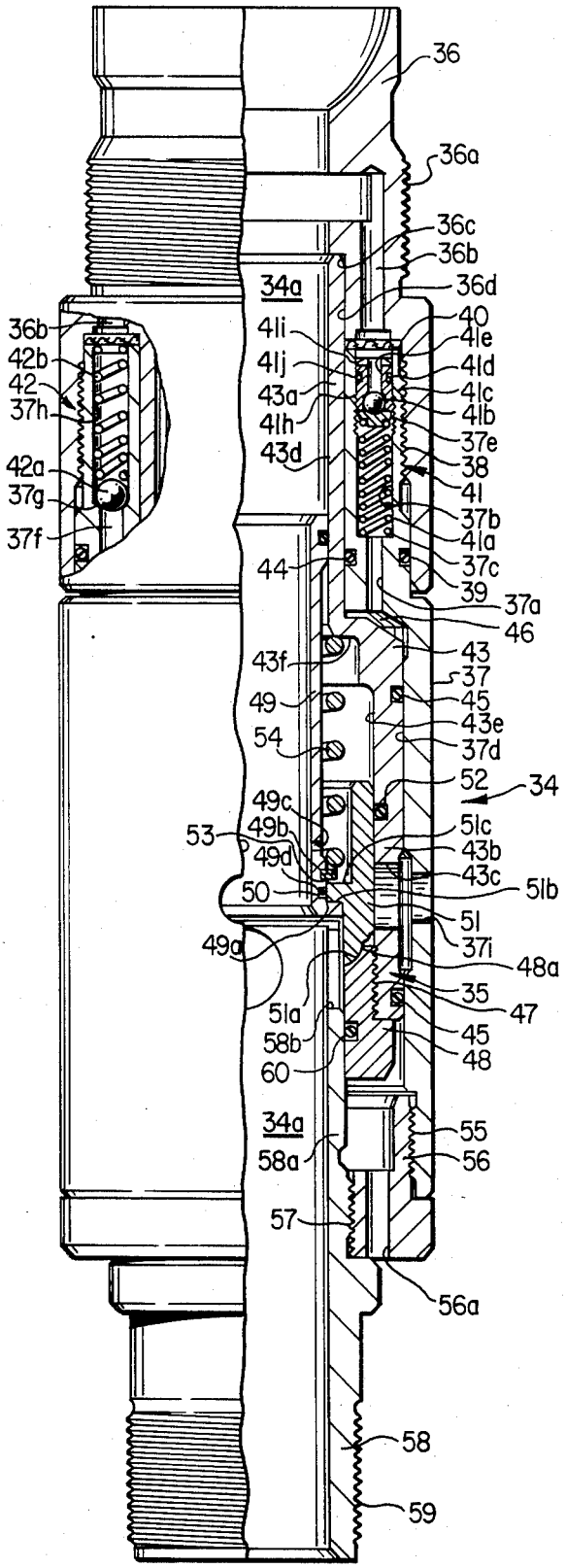
FIG. 10 is a partially sectioned elevation view drawing of the annular valve form of the standing injection valve of this invention in closed position.
Figure 11:
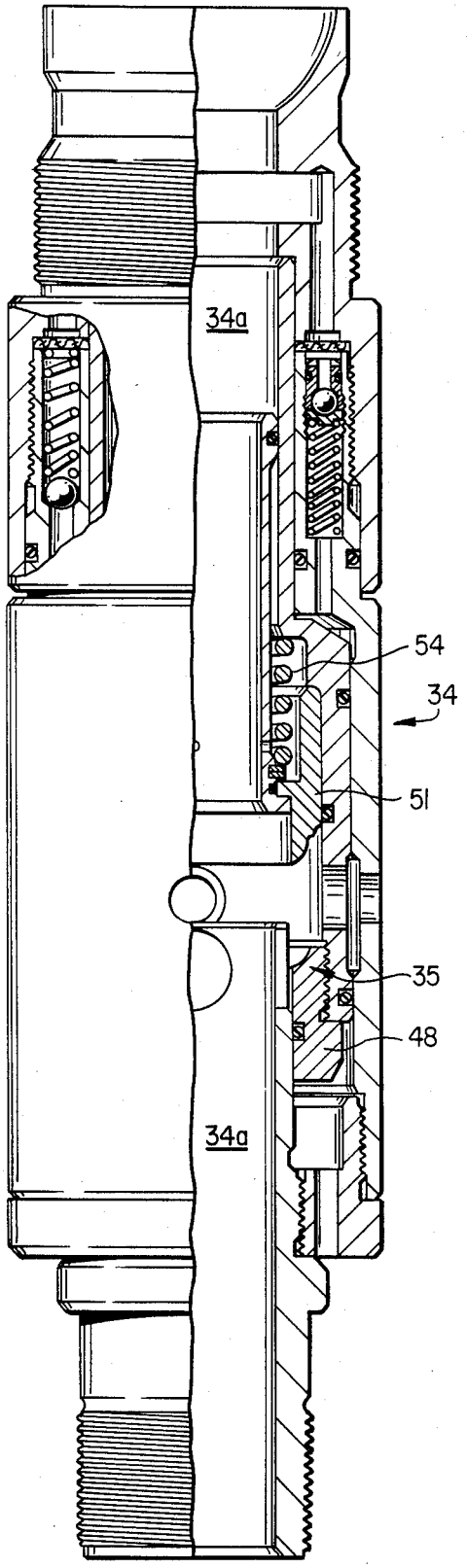
FIG. 11 is a drawing showing the standing injection valve of FIG. 10 open for production flow.
Figure 12:
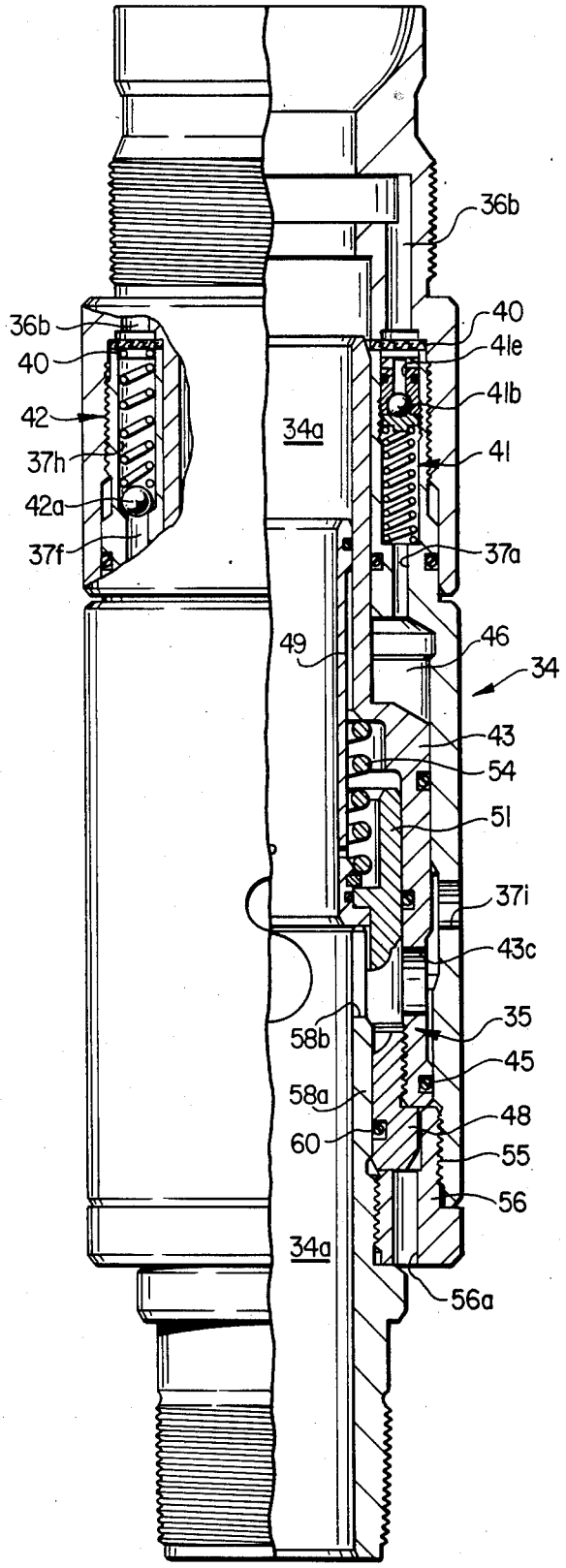
FIG. 12 is a drawing showing the valve of FIG. 10 in open position for injection flow.

FIGS. 10, 11 and 12 show another form 34 of the standing injection valve of this invention, which utilizes annular valve 35 to control flow between interior flow passage 34*a* and regions exterior of this valve. Valve 34, as shown in FIG. 10, has a connector 36 having an appropriate thread 36*a* for connecting the valve in a well flow conduit or in a well tool string. The connector also has a number of flow passages 36*b* in communication with passage 34*a*, a shoulder 36*c* and a bore 36*d*. The connector is connected and sealed to housing 37 with thread 38 and resilient seal 39. A filter 40 is trapped between the housing and connector. The housing is provided with a flow passage 37*a* having a counterbore 37*b* which is in communication with passage 36*b*, a shoulder 37*c* and a bore 37*d*. Installed in counterbore 37*b* is an inlet control check valve 41. The check valve includes a spring 41*a*, bearing on shoulder 37*c* and sealingly engaging a valve ball 41*b* with a seal surface 41*c* on seat 41*d*. The seat has a flow passage 41*e*, which communicates with passage 36*b* through filter 40. The seat also has threads 41*h* engaged in counterbore threads 37*e* and a slot 41*i* and is sealed in bore 37*b* with resilient seal 41*j*.

The housing is provided with at least one more flow passage 37*f*, which has a sealing surface 37*g* and a counterbore 37*h* in communication with passage 36*b* through filter 40. Installed in counterbore 37*h* is a check valve 42. The check valve includes a valve ball 42*a* and a spring 42*b*.

Slidably mounted in housing bore 37*d* is an annular piston 43 having an upper extension 43*a*, extending into connector bore 36*d* and a lower extension 43*b*. The upper extension has a bore 43*d* and the lower extension has a bore 43*e* and the piston has an internal shoulder 43*f*. The upper extension is sealed in bore 36*d* with resilient seal 44 and sealed in bore 37*d* with resilient seal 45 and forms variable volume pressure chamber 46.

Housing 37 is provided with at least one port 37*i* and piston extension 43*b* also has at least one port 43*c*. The lower piston extension is sealed in housing bore 37*d* below port 43*c* with another resilient seal 45. Attached to the lower piston extension with threads 47 is an annular seat 48 having a sealing surface 48*a*.

Slidably mounted in piston bore 43*d* is a valve mandrel 49, which has a shoulder 49*a*, a groove 49*b*, a vent port 49*c* and another groove 49*d*. An annular valve 51 is slidably mounted and sealed in piston bore 43*e* with resilient seal 52 and sealed to valve mandrel 49 with resilient seal 50. This valve has a sealing surface 51*a*, which is sealingly engageable with sealing surface 48*a* and has internal shoulders 51*b* and 51*c*. A retaining ring 53 has been installed in groove 49*b*, trapping shoulders 51*b* and 51*c* between the ring and shoulder 49*a* and rotatably connecting mandrel 49 to valve 51. A spring 54 is positioned around mandrel 49 between the retaining ring and piston shoulder 43*f*.

Connected to the lower end of housing 37 with thread 55 is a bushing 56, which is provided with a flow passage 56*a*. Connected in the bushing with threads 57 is a lower connector 58, which is provided with threads 59 (if required), an extension 58*a* and at least one port 58*b*. The annular seat 48 is slidably mounted around and sealed to extension 58*a* by resilient seal 60.

The annular valve form of the standing injection valve of this invention, as shown in FIG. 10, may be operated in a well conduit as a standing valve or an injection valve. Before installation in a well, the opening pressure of control check valve 41 should be set to the desired opening pressure of annular valve 35 for injection flow. The opening pressure of valve 41 may be varied and determined by turning seat 41*e*. The biased closed valve is then connected or installed in a well flow conduit with the producing formation in communication with annular valve 35 through ports 37*i* and 43*c* and valve flow passage 34*a* in communication with the inside of the well conduit. When higher pressure exterior of the valve acts through port 37*i* up on seal 45 above port 37*i* and down on seal 45 below port 37*i*, annular piston 43 is not moved in either direction as the areas sealed are equal. When pressure exterior of the valve acts through port 37*i* up on seal 45 above port 37*i* and down on seal 45 below port 37*i*, annular piston 43 is not moved in either direction as the areas sealed are equal. When pressure exterior of the valve acting through port 43*c* and upwardly on the annular area sealed by resilient seals 50 and 52 develops sufficient force to overcome the downward force of spring 54, annular valve 51 and connected mandrel 49 move upwardly from annular seat 48, opening valve 35 for production flow from exterior of the valve through port 37*i* and port 43*c* into flow passage 34*a* and up the well conduit. Increased flow volume will further compress spring 54 and move valve 51 upwardly to open position as shown in FIG. 11. On sufficient reduction of flow and pressure exterior of the valve, spring 54 extends, moving valve 51 downwardly to sealingly engage seat 48 as shown in FIG. 10. Now if pressure in passage 34*a* becomes higher than pressure exterior of the valve, the higher pressure acts through vent port 49*c* and downwardly on the area sealed by resilient seals 50 and 52, sealing valve 51 tighter on seat 48. Resilient seal 60 prevents flow between seat 48 and extension 58*a* and no flow can occur from flow passage 34*a* through valve 51 and ports 43*c* and 37*i* to the exterior of valve 34.

When it is desirable to operate the standing injection valve 34 as an injection valve, pressure is increased in flow passage 34*a*. This pressure acts through flow passages 36*b*, filter 40 and into seat flow passage 41*e* on valve ball 41*b* and into counterbore 37*h* on valve ball 42*a* closing check valve 42. When pressure in passage 34*a* acting on valve ball 41*b* reaches the predetermined opening pressure of control check valve 41, valve 41 opens and flow occurs through flow passage 37*a* into chamber 46, moving piston 43 and seat 48 downwardly compressing spring 54 and exhausting fluids below lower resilient seal 45 and resilient seal 60 through passage 56*a* to exterior of valve 34. Increased pressure in valve passage 34*a* will move piston 43 and seat 48 down to the open position of valve 35 as shown in FIG. 12.

Annular valve member 51 and connected mandrel 49 cannot move down as the lower end of the mandrel is stopped on the upper end of connector extension 58*a* and injected flow may occur from passage 34*a* through connector ports 58*b*, open valve 35, ports 43*c* and 37*i* to the valve 34 exterior.

On reduction of injected flow and pressure in passage 34*a*, spring 54 extends, moving piston 43 and seat 48 upwardly closing control check valve 41 and opening check valve 42, permitting fluid to flow from chamber 46 back into passage 34*a*. On continued upward movement of the piston, seat 48 is sealingly reengaged with valve member 51, closing valve 35 to flow, as shown in FIG. 10. Valve 34 will continue to operate as a standing valve in response to sufficiently higher exterior production pressure or as an injection valve if pressure in the well conduit and flow passage 34*a* is increased sufficiently to open the annular valve. The inside diameter of valve mandrel 49 may be decreased as required to choke and control injected flow volume or production flow into the well conduit.

What is claimed is:

1. A standing valve comprising:

(a) a housing having a longitudinal flow passage therethrough and at least one lateral port in the housing wall communicating between said flow passage and the valve exterior;

(b) annular valve means in said housing for controlling flow through said lateral port;

(c) first operator means for operating said annular valve means between open and closed positions;

(d) second operator means for moving said annular valve means to open position permitting two-way flow between the valve exterior and said housing flow passage through said lateral port; and (e) control means for controlling pressure required to operate said second operator means.

2. The standing valve of claim 1 wherein the first operator means comprise:

(a) biasing means holding the annular valve means in closed position; and (b) a pressure responsive area on the annular valve means responsive to pressure exterior of the valve.

3. The standing valve of claim 2 wherein the second operator means comprise:

(a) pressure responsive means responsive to pressure in the housing longitudinal flow passage; and (b) a flow passage in the housing wall commuicating said housing flow passage with said pressure responsive means.

4. The standing valve of claim 3 wherein the control means is a spring loaded check valve in the housing wall flow passage permitting flow from the housing longitudinal flow passage to the pressure responsive means and preventing flow from the pressure responsive means to the housing flow passage.

5. The injection valve as defined by claim 1 wherein the second operator means includes additonal flow passages in the housing wall communicating the housing flow passage with the pressure responsive means.

6. The injection valve as defined by claim 5 wherein the control means further include a check valve in each additional wall flow passage permitting flow from the pressure responsive means to the housing flow passage and preventing flow from the housing flow passage to the pressure responsive means.

7. The injection valve as defined in claim 4 wherein the pressure responsive means is a piston slidably mounted in and sealed to the valve housing above and below the lateral port, said piston having a wall port between said seals and forming a variable volume pressure chamber with said housing.

8. The valve as defined in claim 7 wherein the annular valve means comprise:

(a) an annular valve member slidably sealed in the pressure responsive piston, and (b) an annular seat below said piston port in said piston, sealingly engageable with said valve member.

9. The valve of claim 8 wherein the first operating means pressure responsive area is the annular sealed area between the outside of the annular valve member and area of the diameter sealed by said valve member sealingly engaging the annular seat in the pressure responsive piston.

10. The valve as defined by claim 8 wherein the means biasing the first operator means is a coil spring between a shoulder in the piston and a shoulder in the annular valve member.

11. A standing valve comprising:

(a) a housing having a longitudinal flow passage therethrough and at least one lateral port in the housing wall communicating between said flow passage and the valve exterior;

(b) annular valve means in said housing for controlling flow through said lateral port;

(c) first operator means for operating said valve means between open and closed positions including a bias holding said valve means in closed position, and a pressure responsive area on said valve means responsive to pressure exterior of the valve;

(d) second operator means for moving said valve means to open position including pressure responsive means responsive to pressure in the housing flow passage, said pressure responsive means having a piston slidably mounted in and sealed to the valve housing above and below said lateral port, said piston having a wall port between said seals and forming a variable volume pressure chamber with said housing, and wall flow passages in said housing comunicating said housing flow passage with said pressure chamber, said valve means including an annular valve member slidably sealed in the pressure responsive piston, and an annular seat below said piston port in said piston sealingly engageable with said valve member, said first operator means pressure responsive area is the annular sealed area between the outside of the annular valve member and the area of the diameter sealed by said valve member sealingly engaging the annular seat in the pressure responsive piston, and said first operator means bias is a coil spring between a shoulder in said pressure responsive piston and a shoulder in said annular valve member; and (e) control means for controlling pressure required to operate said second operator means including a spring loaded check valve in one housing wall flow passage, permitting flow from said housing longitudinal passage to said variable volume pressure chamber, and a check valve in each of the other housing wall flow passages, permitting flow from the variable volume pressure chamber to said housing longitudinal passage.

* * * * *

UNITED STATES PATENT AND TRADEMARK OFFICE

CERTIFICATE OF CORRECTION

PATENT NO. : 4,691,777

DATED : September 8, 1987

INVENTOR(S) : Jimmie R. Williamson, Jr.

It is certified that error appears in the above-identified patent and that said Letters Patent is hereby corrected as shown below:

Column 7, line 55, delete the word "injection".

Column 7, line 59, delete the word "injection".

Column 7, line 65, delete the word "injection".

Signed and Sealed this

Nineteenth Day of January, 1988

*Attest:*

*Attesting Officer*

DONALD J. QUIGG

*Commissioner of Patents and Trademarks*